US006382477B1

(12) United States Patent
Yamamoto et al.

(10) Patent No.: US 6,382,477 B1
(45) Date of Patent: May 7, 2002

(54) APPARATUS FOR CONTROLLING AMOUNT OF TEEMING MOLTEN METAL AND SLIDE PLATE USED FOR THE SAME

(75) Inventors: Hironori Yamamoto, Tokyo; Masahiro Tsuru, Kanagawa, both of (JP)

(73) Assignees: Tokyo Yogyo Kabushiki Kaisha; NKK Corporation, both of Tokyo; Nippon Rotary Nozzle Co., Ltd.; Kokan Kikai Kogyo Kabushiki Kaisha, both of Kanagawa, all of (JP)

( * ) Notice: Subject to any disclaimer, the term of this patent is extended or adjusted under 35 U.S.C. 154(b) by 0 days.

(21) Appl. No.: 09/530,390

(22) PCT Filed: Apr. 23, 1998

(86) PCT No.: PCT/JP98/01865

§ 371 Date: Mar. 2, 2001

§ 102(e) Date: Mar. 2, 2001

(87) PCT Pub. No.: WO99/22893

PCT Pub. Date: May 14, 1999

(30) Foreign Application Priority Data

Oct. 31, 1997 (JP) ..... 9-300374

(51) Int. Cl.[7] ..... B22D 41/08
(52) U.S. Cl. ..... 222/600; 222/597
(58) Field of Search ..... 222/600, 597, 222/594

(56) References Cited

U.S. PATENT DOCUMENTS 4,840,296 A * 6/1989 Otsuka et al. ..... 222/600
5,709,807 A * 1/1998 Yoshihara ..... 222/600
6,026,996 A * 2/2000 Hayakawa et al. ..... 222/600

FOREIGN PATENT DOCUMENTS

JP 57-44668 11/1982

* cited by examiner

*Primary Examiner*—Scott Kastler
(74) *Attorney, Agent, or Firm*—Anderson Kill & Olick; Eugene Lieberstein; Michael N. Meller

(57) ABSTRACT

This invention intends to provide a molten metal pouring amount control apparatus in which a sliding resistance of a slide frame is small and a pressing force around a nozzle hole is stabilized so that there is no fear that any trouble such as a molten metal leakage occurs and further, a structure thereof is simple and maintenance cost is low. More specifically, this invention provides a molten metal pouring amount control apparatus for adjusting an opening of a nozzle hole in a fixed plate and an opening of a nozzle hole in a sliding plate by sliding a slide frame by means of a driving means, the control apparatus further comprising guide units each including a plurality of steel balls arranged in line between the slide frame and springs, the guide units being provided on both sides of the sliding plate.

3 Claims, 15 Drawing Sheets

RELATION BETWEEN MOLTEN METAL LEAKAGE AND PAD RATIO

APPARATUS FOR CONTROLLING AMOUNT OF TEEMING MOLTEN METAL AND SLIDE PLATE USED FOR THE SAME

This case is a 371 filing of PCT/JP98/01865, filed on Apr. 23, 1998.

BACKGROUND OF THE INVENTION

1. Field of the Invention

The present invention relates generally to molten metal pouring amount control apparatus which is attached to a bottom of a molten metal container such as a ladle and tongue dish and slides a sliding plate to adjust an opening of a nozzle hole between the sliding plate and a fixed plate so as to control a molten metal pouring amount.

2. Description of the Related Art

Usually, the molten metal pouring amount control apparatus comprises a fixed plate made of refractory product detachably attached to a base plate fixed on a ladle or the like having a nozzle hole and a sliding plate made of refractory product detachably attached to a slide frame having a nozzle hole. By sliding the slide frame along the base plate, openings of a nozzle hole of the fixed plate and that of the sliding plate are adjusted so as to control a pouring amount of molten metal.

The sliding type of the slide frame in such a molten metal pouring amount control apparatus includes metal sliding type and roller sliding type.

Examples of the metal sliding type have been disclosed in Japanese Patent Application Publication No. 48-4697, Japanese Patent Application Publication No. 7-75771 and Japanese Patent Application Laid-Open No. 7-164134.

According to this metal sliding type, a sliding face between the fixed plate and sliding plate and a sliding face between the slide frame and guide member are coated with lubricant so that the sliding plate is pressed against the fixed plate through the slide frame so as to prevent a leakage of molten metal. To slide the slide frame to adjust the opening of the nozzle hole, a driving force larger than a sum of a frictional force generated on the sliding face between the fixed plate and sliding plate and a frictional force generated in the sliding face between the slide frame and guide member is necessary.

In this case, because the frictional force generated between the slide frame made of metal material and guide member is large, a high-output driving means (usually, a hydraulic cylinder is used) is necessary for driving the slide frame and a strength sufficiently capable of bearing a high load is needed.

Further, because the slide frame and its guide members are worn out, they need to be replaced with new one before or after 500 heats for example. Thus, maintenance cost such as disassembly cost and parts cost increases. Further each time when molten metal is charged, the sliding face between the fixed plate and sliding plate and the sliding face between the slide frame and guide member must be coated with lubricant, and this work is troublesome.

However, according to the metal sliding type, a spring force application point always exists below the nozzle hole of the fixed plate and nozzle hole of the sliding plate even if the slide frame is slid. Therefore, there is an advantage that a pressing force around the nozzle hole which is the most important is secured and this is why the metal sliding type has been widely used up to now.

The other type of roller sliding was invented to solve a problem on friction generated in the aforementioned metal sliding type and has been disclosed in, for example, Japanese Patent Publication No.SHO62-58816 and Japanese Patent Publication No.HEI1-38592.

According to the former invention, as shown schematically in FIG. 12, rollers 107*a*, 107*b* are provided at fixed positions on a guide member 106 and a slide frame 105 having the sliding plate 103 is installed on these rollers 107*a*, 107*b*. Then, the sliding plate 103 is pressed against a fixed plate 101 by a spring 108 interposed between a casing cover 109 and a guide member 106 (hereinafter this is referred to as a fixed roller type) According to the latter invention, as shown schematically in FIG. 13, the rollers 107*a*, 107*b* are provided on the slide frame 105 and then, mounted on the guide member (rail). The sliding plate 103 is pressed against to the fixed plate 101 by the spring 108 (hereinafter this is referred to as moving roller type).

Such a roller sliding type is capable of reducing a frictional force generated in sliding of the sliding plate by using the rollers and reduction of its unit price and maintenance cost can be expected.

In the fixed roller type of the aforementioned roller sliding type, when the nozzle holes 102, 104 are fully opened, as shown in FIG. 12(*a*), the pressing force of the sliding plate 103 is applied around the nozzle hole 102 of the fixed plate 101 by the rollers 107*a*, 107*b* uniformly, so that portions around the nozzle holes 102, 104 make firm contact with each other. Thus, there is no fear that any molten metal invades in between the fixed plate 101 and sliding plate 103.

However, because the positions of the rollers 107*a*, 107*b* are constant, as the slide frame 105 is moved in a direction for closing the nozzle holes 102, 104 (direction indicated by an arrow), as shown in FIG. 12(*b*), acting points of the rollers 107*a*, 107*b* against a portion around the nozzle hole 104 of the sliding plate 103 are moved, so that the pressing force applied around the nozzle hole 104 becomes unstable. Further, when the nozzle holes 102, 104 are closed fully, as shown in FIG. 12(*c*), the nozzle hole 104 is apart from the acting points of the rollers 107*a*, 107*b*, so that the pressing force around the nozzle hole 104 drops.

In this condition, molten metal is likely to invade in between the fixed plate 101 and the sliding plate 103 through the nozzle hole 102. If the invading molten metal is solidified, the contact of the sliding plate 103 by pressing with the springs 108 becomes difficult, so that a leakage of the molten metal is generated from a gap between the both plates.

On the other hand, in case of the moving roller type, although the pressing force around the nozzle hole 104 in the sliding plate 103 is stabilized different from the case of the fixed roller type, as shown in FIG. 13(*a*), the pressing force around the nozzle hole 102 in the fixed plate 101 drops as the slide frame 105 is moved in a closing direction (direction indicated by an arrow) as shown in FIGS. 13(*b*), (*c*). Therefore, the same problem as the case of the fixed roller type is generated.

In such a fixed roller type and moving roller type, if a distance between the rollers 107*a* and 107*b* is made long, the pressing force around the nozzle holes 102, 104 can be secured in an entire range from the full opening of the nozzle holes 102, 104 to the full closing thereof. In this case, naturally, the slide frame 105, guide member 106 and casing cover 109 have to be extended. Consequently, the entire apparatus becomes very long, so that not only increase of cost is induced, but also this apparatus may not be mounted on a bottom face of the molten metal container.

Further, because the rollers 107*a*, 107*b* have to be reduced in size, the service life of shafts for supporting them is short and therefore they have to be replaced sometimes. Thus, maintenance cost cannot be saved sufficiently. Further, because complicated parts such as a lever and the like in the invention described in the aforementioned Japanese Patent Publication No.SHO62-58816 and an intermittent rail and the like in the invention described in Japanese Patent Publication No.HEI1-38592 are necessary, reduction of the price of the apparatus cannot be expected.

For the reason, although the molten metal pouring amount control apparatus based on the roller sliding type has a technical advantage that the sliding friction of the slide frame is small, it cannot currently be in a mainstream of sliding type of the slide frame.

Accordingly, a first object of the present invention is to solve the above described problems and provide a molten metal pouring amount control apparatus in which the sliding resistance of the slide frame is small and the pressing force around the nozzle hole is stabilized so that there is no fear that any trouble such as a leakage of molten metal occurs and a structure thereof is simple and production cost and maintenance cost are cheap.

On the other hand, a conventional sliding plate for use in the above described pouring amount control apparatus is shown. A first example is a polygon plate whose plain view and side sectional view are shown in FIG. 18 and FIG. 19 respectively. A second example is an oval plate 113 whose plain view and side sectional view are shown in FIGS. 20, 21 respectively. Reference numerals 112, 114 denote nozzle holes of the respective plates. Upon use, these plates are overlaid and one of them is slid as a sliding plate so as to control opening/closing of the nozzle hole to adjust the flow rate of molten metal.

From previous operation experience for a long time, most molten metal leakage occur when the nozzle is located at the opening position and it hardly occurs at the closing position thereof. The reason is that although a function for controlling a passage amount of the molten metal is necessary at the opening position of the nozzle, a function necessary for the closing position is only to stop the flow of the molten metal.

However, conventionally, the shape at the opening position or closing position of the nozzle hole has not been determined sufficiently reasonably considering its function and economic performance.

The sliding plate is melted and lost by a passage of high temperature molten metal and the like. Therefore, there is a fear that the molten metal and the like may leak if it is used too frequently. Thus, the sliding plate is replaced every several charges and handled as a consumption product However, because this sliding plate is made of refractory product like an expensive brick, the running cost is high and this is an obstructive factor against reduction of cost.

Therefore, a second object of the present invention is to form a sliding plate in an economic shape within a range which does not generate a leakage of the molten metal in views of these problems so as to reduce the unit price thereby achieving a reduction of long period cost to a large extent.

SUMMARY OF THE INVENTION (1) To achieve the above described object, according to a first aspect of the present invention, there is provided a molten metal pouring amount control apparatus comprising: a driving means for a slide frame; a base plate which is provided with a fixed plate having a nozzle hole and is to be attached to a molten metal container; a frame which is mounted to the base plate through a hinge in such a manner that the frame can be opened and closed; and a slide frame which is accommodated in the frame slidably in a horizontal direction, driven by a driving means and provided with a sliding plate having a nozzle hole, and in which the sliding plate is pressed against the fixed plate by springs interposed between the sliding plate and the frame, the molten metal pouring amount control apparatus further comprising guide units each having a plurality of steel balls disposed in line between the slide frame and the springs, the guide units being disposed on both sides of the sliding plate.

With this structure, the sliding resistance of the slide frame is small and the driving means can be reduced in size. Further, the pressing force around the nozzle hole is stabilized so that there is no fear that a leakage of molten metal occurs and the structure is simple and therefore maintenance cost can be reduced.

(2) According to a second aspect of the present invention, there is provided a molten metal pouring amount control apparatus according to the first aspect wherein each of the guide units includes: a retainer having a plurality of holes arranged in line so that the steel balls are accommodated rotatably in the holes with upper and lower portions of the balls being exposed through the holes; an upper lace which is provided with a guide groove on its bottom face and fixed on a bottom face of the slide frame; and a lower lace which is provided with a guide groove provided on its top face and fixed on a spring receiver disposed on a plurality of the springs movably up and down between a guide frame and the frame, the retainer being nipped between the upper and lower laces.

As a result, such an event that adjacent steel balls contact each other thereby obstructing a rotation thereof never occurs, so that the slide frame can be slid smoothly. Further, the pressing force of the sliding plate by the spring can be stabilized regardless of the position of the slide frame.

(3) According to a third aspect of the present invention, there is provided a molten metal pouring amount control apparatus according to the second aspect wherein each of gaps between the retainer and the upper lace/the lower lace is 0.1–1.0 mm.

As a result, the sliding resistance can be reduced and there is no fear that foreign matter invades in between the steel balls to resultantly increase the sliding resistance or damage the steel balls and retainer.

(4) According to a fourth aspect of the present invention, there is provided a sliding plate having a nozzle hole for use in a molten metal pouring amount control apparatus, for controlling a pouring amount of molten metal, wherein assuming a center position of the nozzle hole is X, a diameter of the nozzle hole is a, a distance from an edge of the nozzle hole up to the nearest edge of the plate is $d_1$, a position apart from the center position X of the nozzle hole by a distance S (=2a+β) is Y, and a distance from a virtual circle of the diameter a around the position Y up to the nearest edge of the plate is $d_2$, a pad ratio $\alpha_1=d_1/a$ is set in the range between 0.8 and 1.5, a pad ratio $\alpha_2=d_2/a$ is set in the range between 0.4 and $\alpha_1$ and safety distance β is set in the range of 0–60 mm.

With this structure, the sliding plate can be formed in an economic shape within a range in which no leakage of molten metal occurs.

(5) According to a fifth aspect of the present invention, there is provided a sliding plate wherein an external shape of the sliding plate is polygon so as to make it easy to fix the plate.

(6) According to a sixth aspect of the present invention, there is provided a sliding plate wherein part of the external shape of the plate comprises part of a first polygon having a virtual inscribed circle of a diameter ($a+2d_1$) around a position X and part of a second polygon having a virtual inscribed circle of a diameter ($a+2d_2$) around a position Y.

(7) According to a seventh aspect of the present invention, there is provided a sliding plate wherein $d_2=d_1/2$.

Consequently, not only the sliding plate can be formed in an economic shape within a range in which no leakage of the molten metal occurs, but also the plate can be fixed more easily by using straight sides of the polygonal shape.

(8) According to an eighth aspect of the present invention, there is provided a sliding plate wherein respective corners of the polygonal shape are replaced with arcs.

Consequently, the size of the sliding plate can be further reduced economically.

(9) According to a ninth aspect of the present invention, there is provided a sliding plate wherein the thickness of a portion around the nozzle hole is larger than the thickness of the other portions.

Consequently, because a thicker portion than the other portion exists around the nozzle hole, the upper and lower nozzles can be engaged with each other easily.

DESCRIPTION OF THE PREFERRED EMBODIMENTS

First Embodiment

Figure 1:
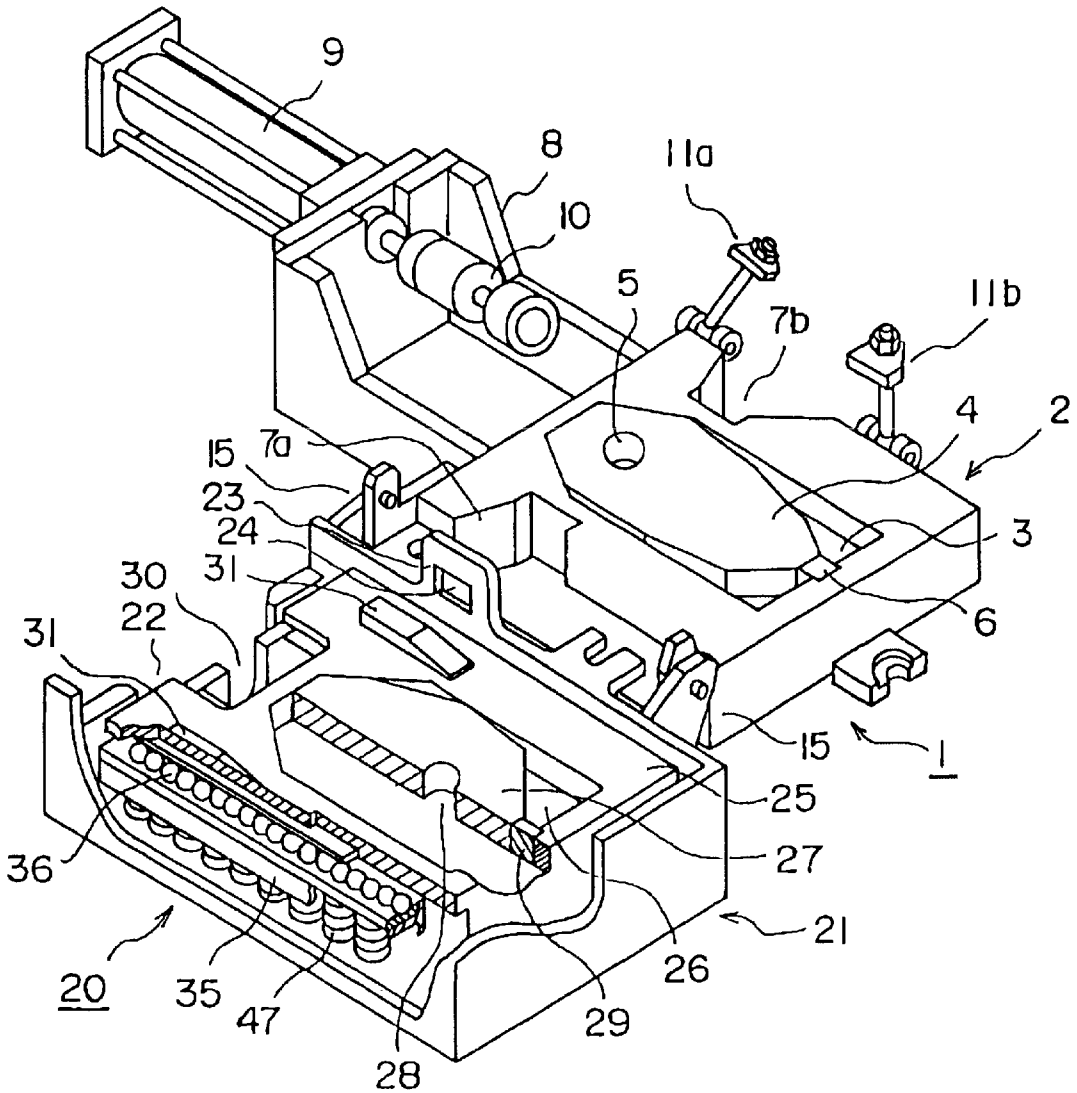
FIG. 1 is a perspective view showing a condition in which a door of a pouring amount control apparatus indicating an example of the present invention is opened.
Figure 2:
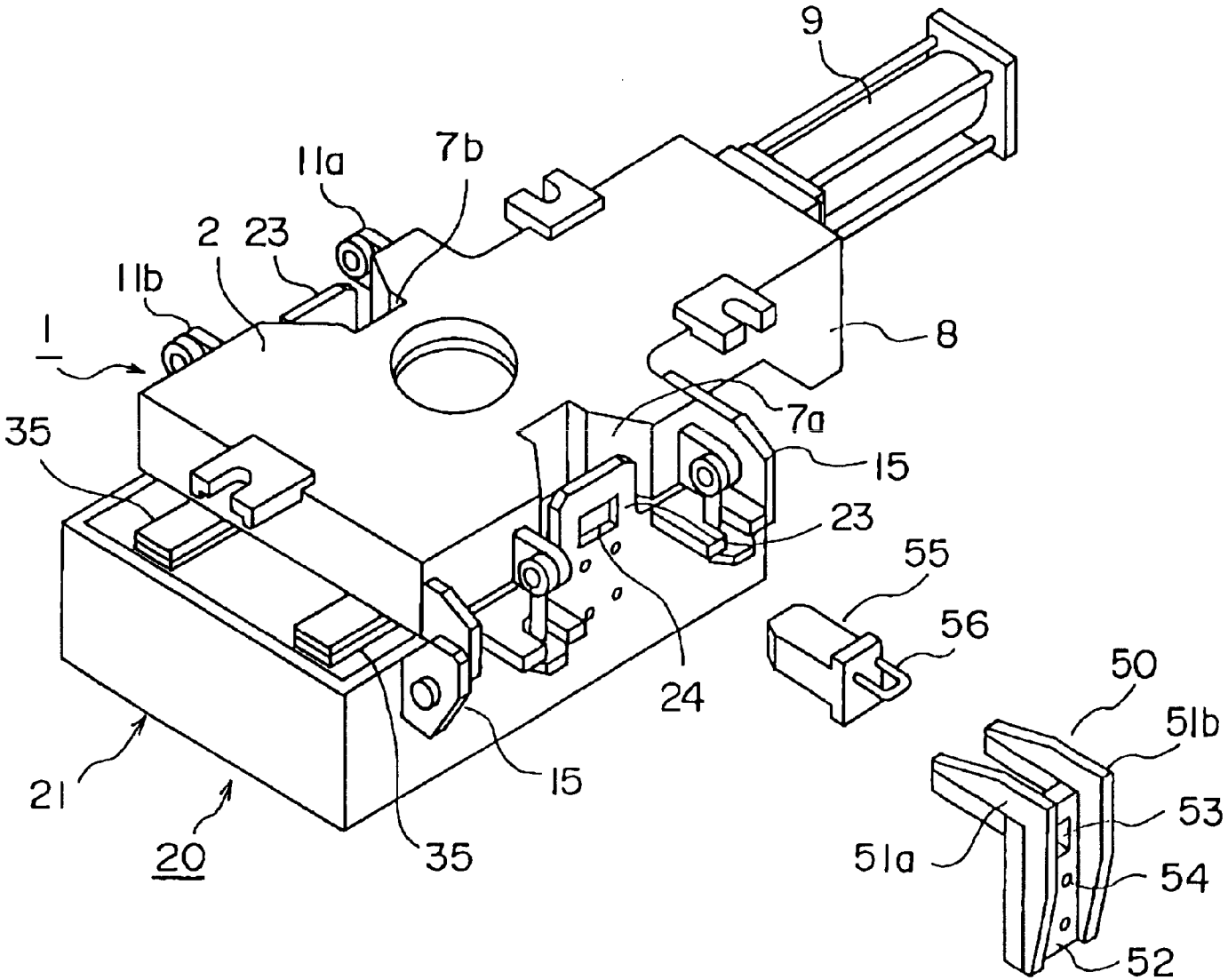
FIG. 2 is a perspective view showing a condition in which the door of FIG. 1 is closed.
Figure 3:
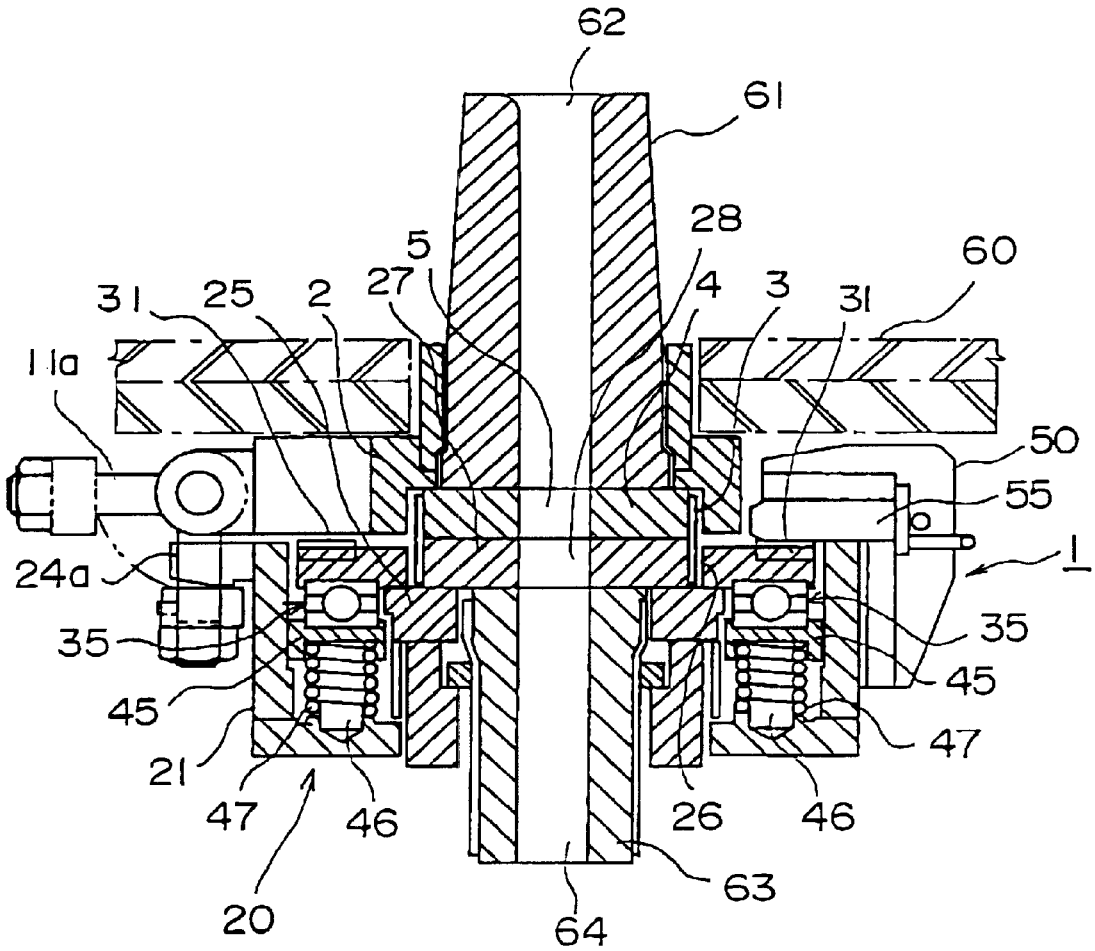
FIG. 3 is a longitudinal sectional view showing a condition in which the pouring amount control apparatus of the present invention is attached to a bottom of the molten metal container.
Figure 4:
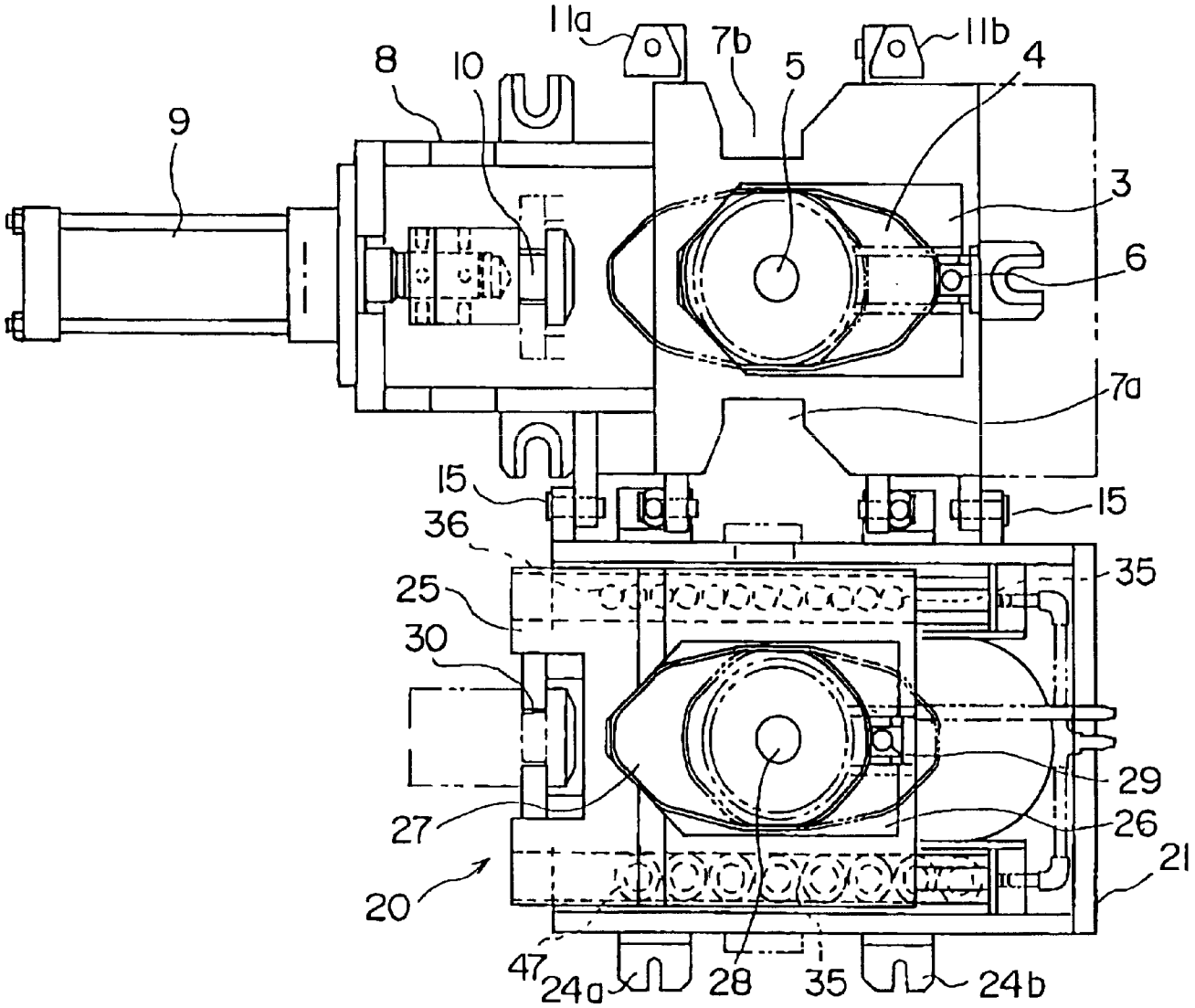
FIG. 4 is a bottom view showing a condition in which the door of FIG. 3 is opened.

FIG. 1 is a perspective view showing a condition in which a door of a pouring amount control apparatus indicating an example of the present invention is opened, FIG. 2 is a perspective view showing a condition in which the door of FIG. 1 is closed, FIG. 3 is a longitudinal sectional view showing a condition in which the pouring amount control apparatus of the present invention is attached to a bottom of the molten metal container and FIG. 4 is a bottom view showing a condition in which the door of FIG. 3 is opened.

In these Figures, reference numeral 2 denotes a base plate fixed to a bottom 60 of a molten metal container (hereinafter referred to as ladle) and it has a concave portion 3. This concave portion 3 contains a fixing plate 4 made of refractory product and having a nozzle hole 5 and is fixed with a fixing metal 6.

Reference numerals 7*a*, 7*b* denote a cutout portion in which part of a clamp mounting metal (which will be described later) is to be inserted. Reference numeral 8 denotes a bracket extending to one side, on which a hydraulic cylinder 9 which is a driving means for a slide frame described later is mounted. An fitting portion 10 is provided at a tip of an actuator thereof. Reference numerals 11*a*, 11*b* denote a swing arm provided on a side wall perpendicular to the bracket 8.

Reference numeral 21 denotes a box like frame mounted to the base plate 2 through hinges 15 such that it can be opened or closed. An opening portion 22 is provided in a side wall (on the side of the bracket 8 of the base plate 2). Further, a vertical wall 23 is provided on each of both side walls perpendicular to this side wall such that they stand up from each side wall. This vertical side wall has a clamp insertion hole 24.

Reference numeral 25 denotes a slide frame incorporated in the frame 21 and a concave portion 26 is provided in a top surface thereof. This concave portion 26 accommodates a sliding plate 27 made of refractory product having a nozzle hole 28 and is fixed with a fixing metal 29. Free surfaces of the fixing plate 4 and sliding plate 27 are located slightly higher than the surfaces of the base plate 2 and slide frame 25 respectively, for example, about 5 mm higher. Reference numeral 30 denotes an engaging portion which is provided in the slide frame 25 on the side of the opening portion 22 of the frame 21 and which the engaging portion of the hydraulic cylinder 9 engages. Reference numeral 31 denotes a liner (cam) which has an inclined face on one side thereof and is provided near the vertical wall 23 of the frame 21 and on a top face of the slide frame 25.

Figure 5:
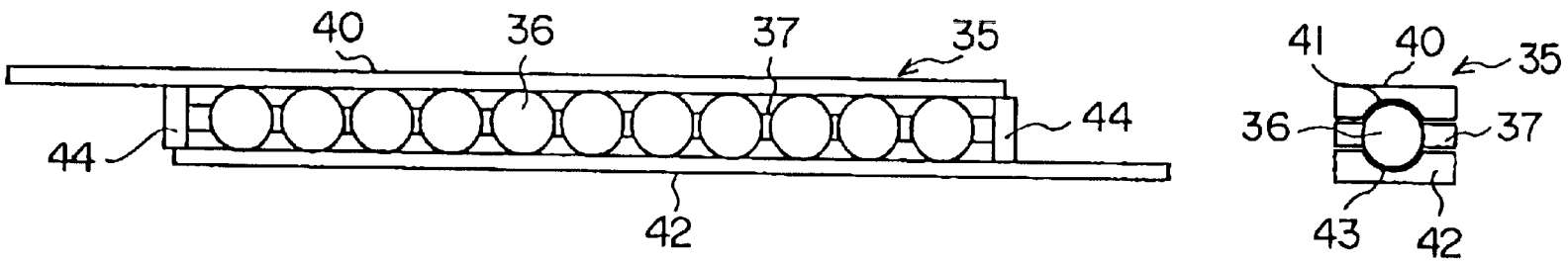
FIG. 5 is a front view and side view of a guide unit for use in this apparatus.
Figure 6:
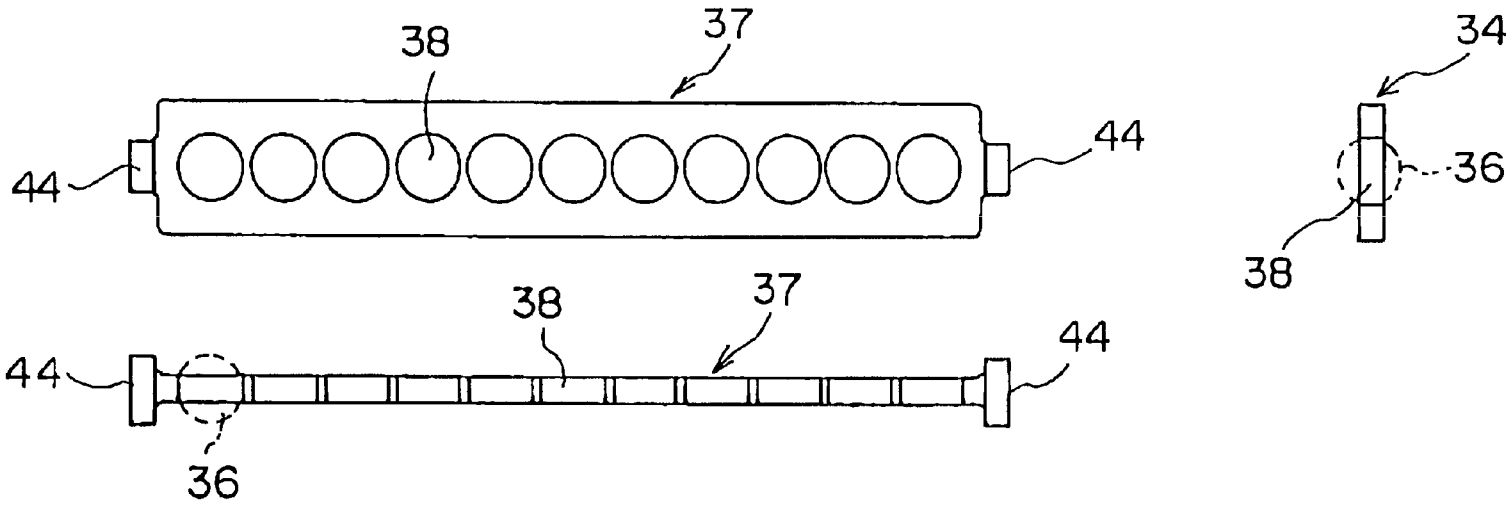
FIG. 6 is a plain view, front view and side view of a retainer shown in FIG. 5.

Reference numeral 35 denotes a guide unit provided below the slide frame 25 and on both sides of the concave portion 26. This guide unit 35, as shown in FIGS. 5, 6, comprises balls 36 each composed of steel ball and arranged in line, a retainer 37 having a plurality of holes 38 each having substantially the same diameter as a diameter of the ball 36 and accommodating the balls 36 such that top and bottom of each ball are exposed from the retainer and they can rotate in that condition, to prevent adjacent balls 36 from making contact with each other and obstructing rotations of each other and upper lace 40 and lower lace 42, disposed above and under the balls 36 having guide grooves 41, 43.

Reference numeral 44 denotes a wiper which is provided on both ends thereof and cleans the guide grooves 41, 43 in the upper and lower laces 40, 42 when it is moved together with the balls 36. However, this is not absolutely necessary for the present invention, and may be omitted.

In FIGS. 1–4 again, reference numeral 45 denotes a spring seat disposed between the frame 21 and slide frame 25 vertically movably, reference numeral 46 denotes a plurality of spring guides provided on a bottom of the frame 21 such that they stand up, and reference numeral 47 denotes a coil spring mounted over the spring guide 46 between the frame 21 and spring seat 45. The upper lace 40 of the guide unit 35 is fixed on a bottom surface of the slide frame 25 and the lower lace 42 is fixed on a top surface of the spring seat 45 so that the balls accommodated by the retainer 37 are nipped. The coil springs 47 urges the slide frame 25 upward through the spring seat 45 and guide unit 35 so as to press-fit the sliding plate 27 to the fixed plate 4. A door 20 is comprised of the frame 21, slide frame 25, guide unit 35 and the like.

The balls 36 are disposed in a range more than (stroke of the slide frame 25 plus diameter of nozzle hole 5)/2 in a retraction direction (on the side of the hydraulic cylinder 9) with respect to the center of the nozzle hole 5 of the fixed plate 4 and more than (stroke of the slide frame 25 plus diameter of the nozzle hole 5)/2 in the advance direction. Because the sliding resistance increases if the retainer 37 comes into firm contact with the upper and lower retainers 40, 42, an appropriate gap is necessary between both of them. However, if the gap is too large, any foreign matter may invade in between the balls 36 so that not only the sliding resistance increases, but also it damages the ball 36 and the retainer 37. Thus, this gap is desired to be 0.1–1.0 mm.

Reference numeral 50 denotes a clamp mounting metal, which is comprised of substantially inverted L shaped side plates 51*a*, 51*b* and a mounting plate 52 fixed between the side plates 51*a* and 51*b*. The mounting plate 52 has clamp guide holes 53 of the same size as the clamp insertion hole 23 provided in the frame 21. The mounting plate 52 of the clamp mounting metal 50 is brought into contact with the side plate of the frame 21 and the clamp guide holes are matched with the clamp insertion holes 23. Then, screws are inserted through screw insertion holes 54 and driven into threaded holes provided in the side wall.

Reference numeral 55 denotes a clamp which is to be inserted into the clamp insertion hole 23 through the clamp guide hole 53 and has a handle 56. Although FIGS. 2, 3 show the clamp mounting metal 50 and clamp 55 on only one side, they are provided on the other side also.

Reference numeral 61 denotes a upper nozzle which has a nozzle hole 62 and is attached to the bottom of the ladle or the like and reference numeral 63 denotes a collector nozzle which has a nozzle hole 64 and is attached to the slide frame 25.

Next, an operation of this apparatus having such a structure will be described. Assume that the base plate 2 is mounted on the bottom 60 of the ladle or the like.

First, the door 20 is rotated with respect to the hinges 15 and the swing arms 11*a*, 11*b* are inserted into U shaped cutouts of lock arms 24*a*, 24*b* provided on the arm 21 and fixed by tightening nuts. At this time, the fitting portion 10 of the hydraulic cylinder 9 engages the engaging portion 30 of the slide frame 25 and the sliding plate 27 is press-fit to the fixed plate 4 by an urging force of the coil spring 47.

Next, the slide frame 25 is retracted up to a position shown in FIG. 4 by the hydraulic cylinder 9. As a result, the nozzle hole 62 of the upper nozzle 61, nozzle hole 5 of the fixed plate 4, nozzle hole 28 of the sliding plate 27 and nozzle hole 64 of the collector nozzle 63 match in line so that the nozzle hole 5 of the fixed plate 4 and the nozzle hole 28 of the sliding plate 27 are opened fully. Consequently, molten metal is discharged from the ladle or the like to outside through the nozzle holes 62, 5, 28, 64.

When controlling a flow rate of molten metal, the slide frame 25 is advanced by the hydraulic cylinder 9 and stopped at a desired position, so that the openings of the nozzle hole 5 of the fixed plate 4 and nozzle hole 28 of the sliding plate 27 are adjusted. Corresponding to this openings, the flow rate is adjusted. If the slide frame 25 is further advanced, the nozzle hole 5 is completely closed by the sliding plate 27. Meanwhile, the sliding direction of the slide frame 25 for adjusting the openings of the nozzle holes 5, 28 is not limited to the above case, however, it may be changed appropriately. When the door 20 is opened to replace the fixed plate 4 or sliding plate 27, it is difficult to remove the swing arms 11*a*, 11*b* from the lock arms 24*a*, 24*b* because the urging force of the coil spring 47 is strong.

Then, according to the present invention, the clamp 55 is inserted into the clamp guide hole 53 in the clamp mounting metal 50 mounted on each of both the side walls of the frame 21 so that it is protruded through the clamp insertion hole 23 to over the slide frame 25. Then, if the slide frame 25 is advanced (or retracted) by the hydraulic cylinder 9, the liner 31 invades under the clamp 55 so that the slide frame 25 is pressed down against an urging force of the coil spring 47. If the swing arms 11*a*, 11*b* are rotated as shown in FIG. 3 in this condition, they can be removed from the lock arms 24*a*, 24*b* easily.

When closing the door 20, the swing arms 11*a*, 11*b* are rotated in the above condition and engaged with the lock arms 24*a*, 24*b*. By retracting (or advancing) the slide frame 25, the liner 31 is disengaged from the clamp 55 and then, the clamp 55 is pulled out.

When the slide frame 25 is advanced or retracted as described above, the slide frame 25 is moved by a rolling friction of the balls 36 in the guide unit 35 interposed between the slide frame 25 and frame 21. Thus, most of the friction resistance against sliding is comprised of friction between the fixed plate 4 and sliding plate 27. Thus, the sliding resistance can be reduced largely as compared to the conventional metal sliding type, so that the hydraulic cylinder 9 can be reduced in size.

Figure 7:
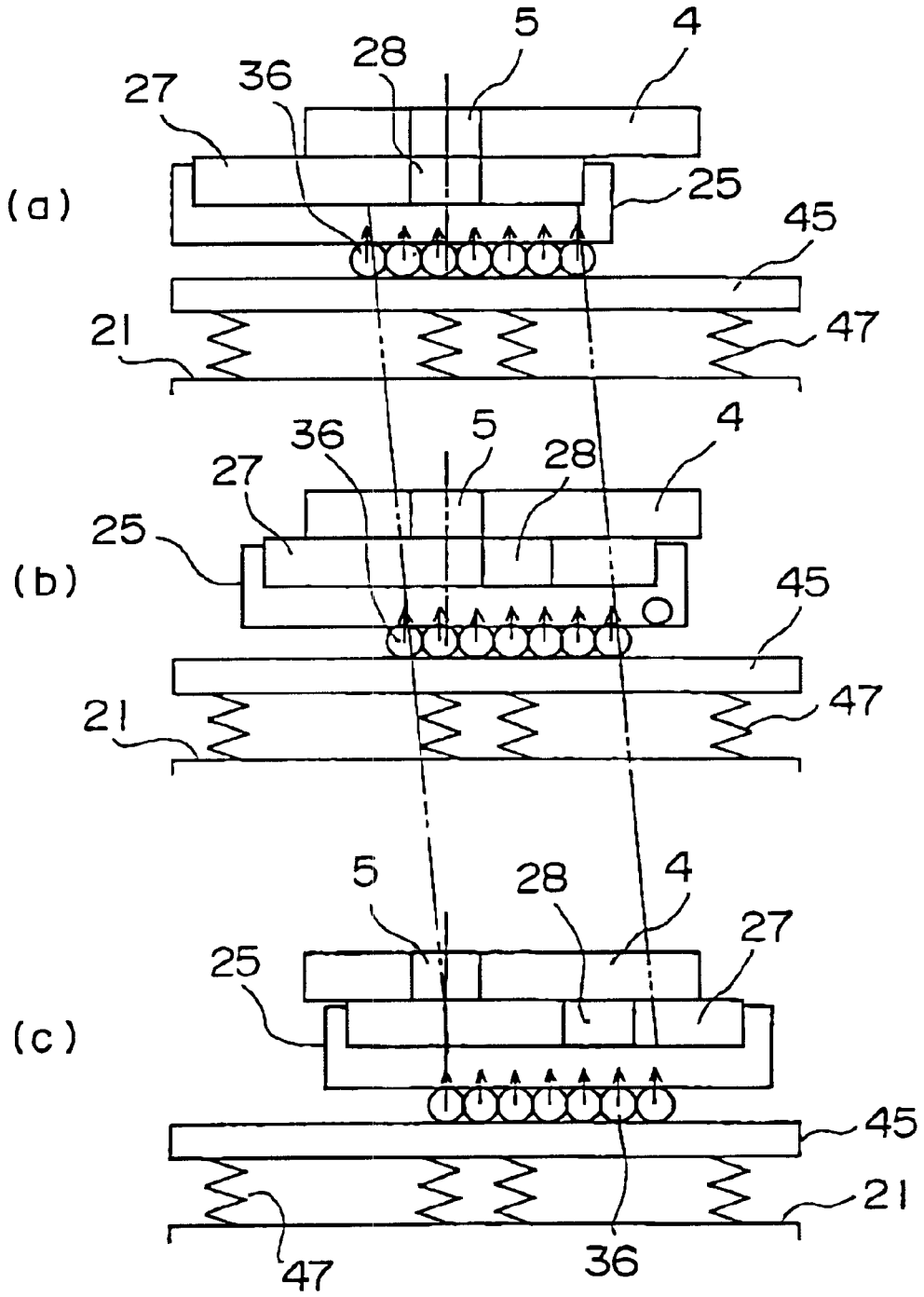
FIG. 7 is an explanatory diagram for explaining an operation of the present invention.

Because if the slide frame 25 is moved, the balls 36 rotate and move following it, as shown in FIG. 7, pressing force by the coil springs 47 exists under the nozzle holes 5, 28 in both the fixed plate 4 and sliding plate 27. Thus, an event that the pressing force becomes insufficient depending on the position of the slide frame never occurs unlike the conventional roller sliding type. Therefore, there is no fear that molten metal may invade in between the fixed plate 4 and sliding plate 27.

Figure 8:
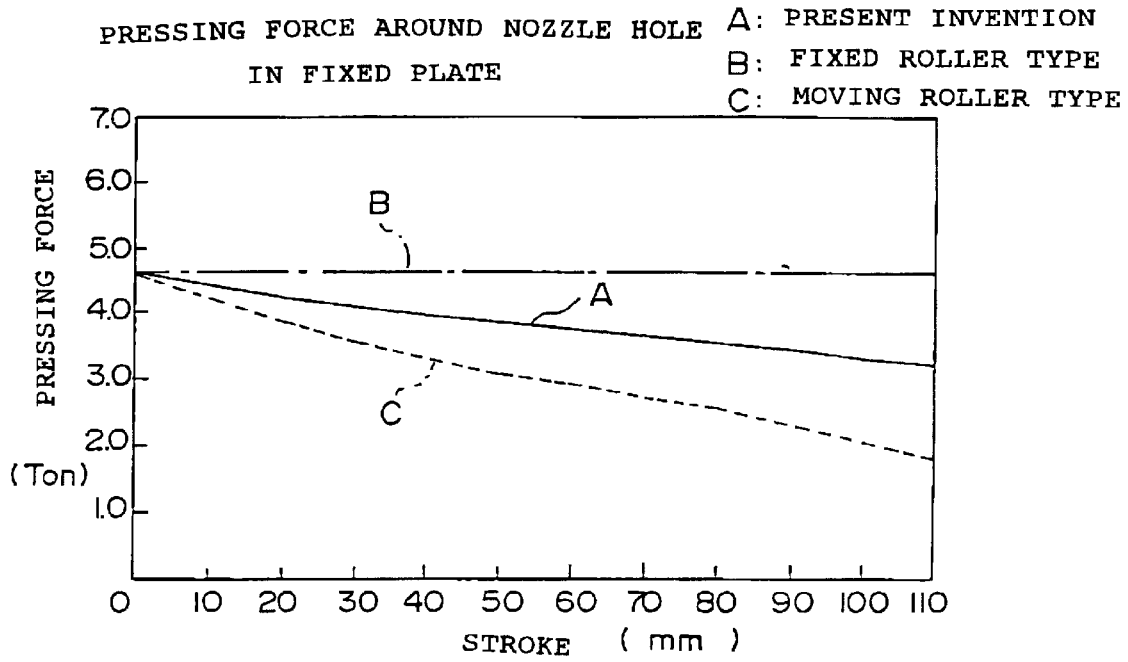
FIG. 8 is a diagram for comparing pressing forces around a nozzle hole in the fixing plates of a conventional roller type, moving type and present invention.
Figure 9:
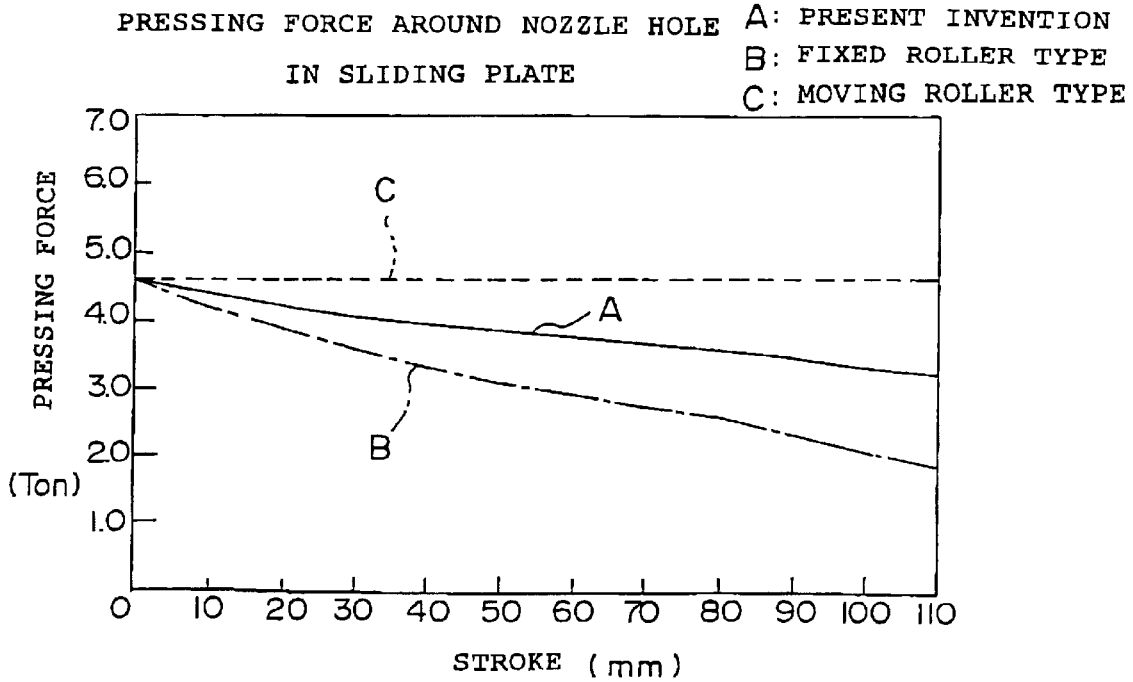
FIG. 9 is a diagram for comparing pressing forces around a nozzle hole in the sliding plates like FIG. 8.

FIGS. 8, 9 are diagrams showing results of the pressing forces around the nozzle holes in the fixed plate and sliding plate of the apparatus of the present invention and the aforementioned fixed roller type and moving roller type, calculated corresponding to a stroke of the slide frame, FIG. 8 shows a pressing force around the nozzle hole of the fixed plate and FIG. 9 indicates a pressing force around the nozzle hole of the sliding plate.

Assuming that total pressing force is 4.6t, the pressing force is 4.6t in any case when the nozzle hole is opened fully (stroke 0).

Although according to the present invention, the pressing force decreases gradually as the stroke length increases, the pressing force is maintained to be 3.2t (about 70% when the nozzle hole is opened fully) even when the nozzle hole is closed completely.

On the other hand, according to the fixed roller type B, although the pressing force around the nozzle hole in the fixed plate is not changed even if the stroke length increases, the pressing force around the nozzle hole in the sliding plate drops largely as the stroke length increases, so that the pressing force when the nozzle hole is completely closed is 1.8t (about 40% when the nozzle hole is opened fully).

According to the moving roller type C, the pressing force around the nozzle hole in the sliding plate is not changed even if the stroke length increases. However, the pressing force around the nozzle hole in the fixed plate drops largely as the stroke length increases, so that the pressing force when the nozzle hole is closed fully is 1.8t.

As evident from FIGS. 8, 9, according to the present invention A, the pressing force around the nozzle hole in the fixed plate and sliding plate drops gradually as the stroke length increases. However, the drop rate is small, so that substantially uniform pressing force can be obtained throughout an entire stroke.

On the contrary, according to the fixed roller type B and sliding roller type C, when the nozzle hole is opened fully and closed fully, the pressing force drops largely as the stroke length increases.

Figure 10:
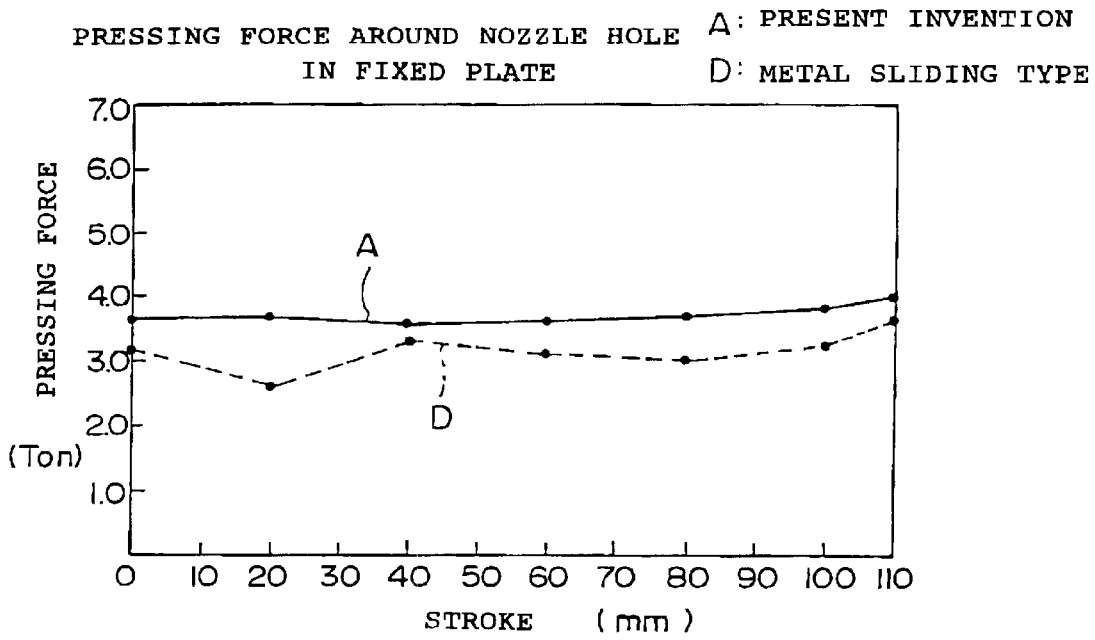
FIG. 10 is a diagram for comparing pressing forces around a nozzle hole in the fixing plates of the present invention and metal sliding type.
Figure 11:
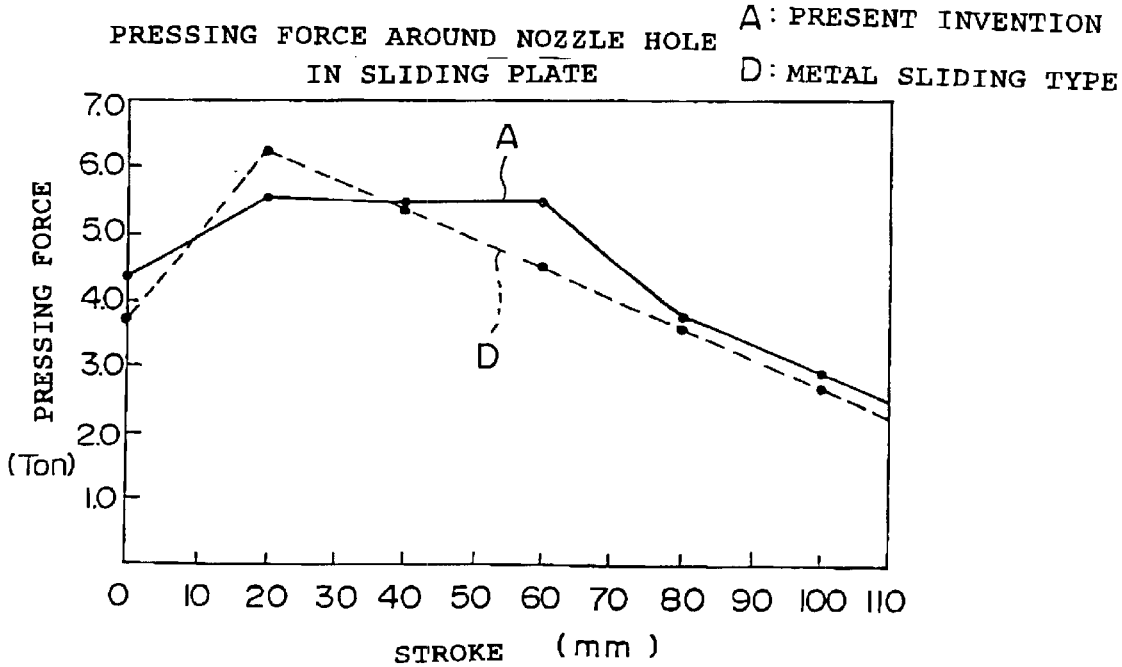
FIG. 11 is a diagram for comparing pressing forces around a nozzle hole in the sliding plates like FIG. 10.
Figure 12:
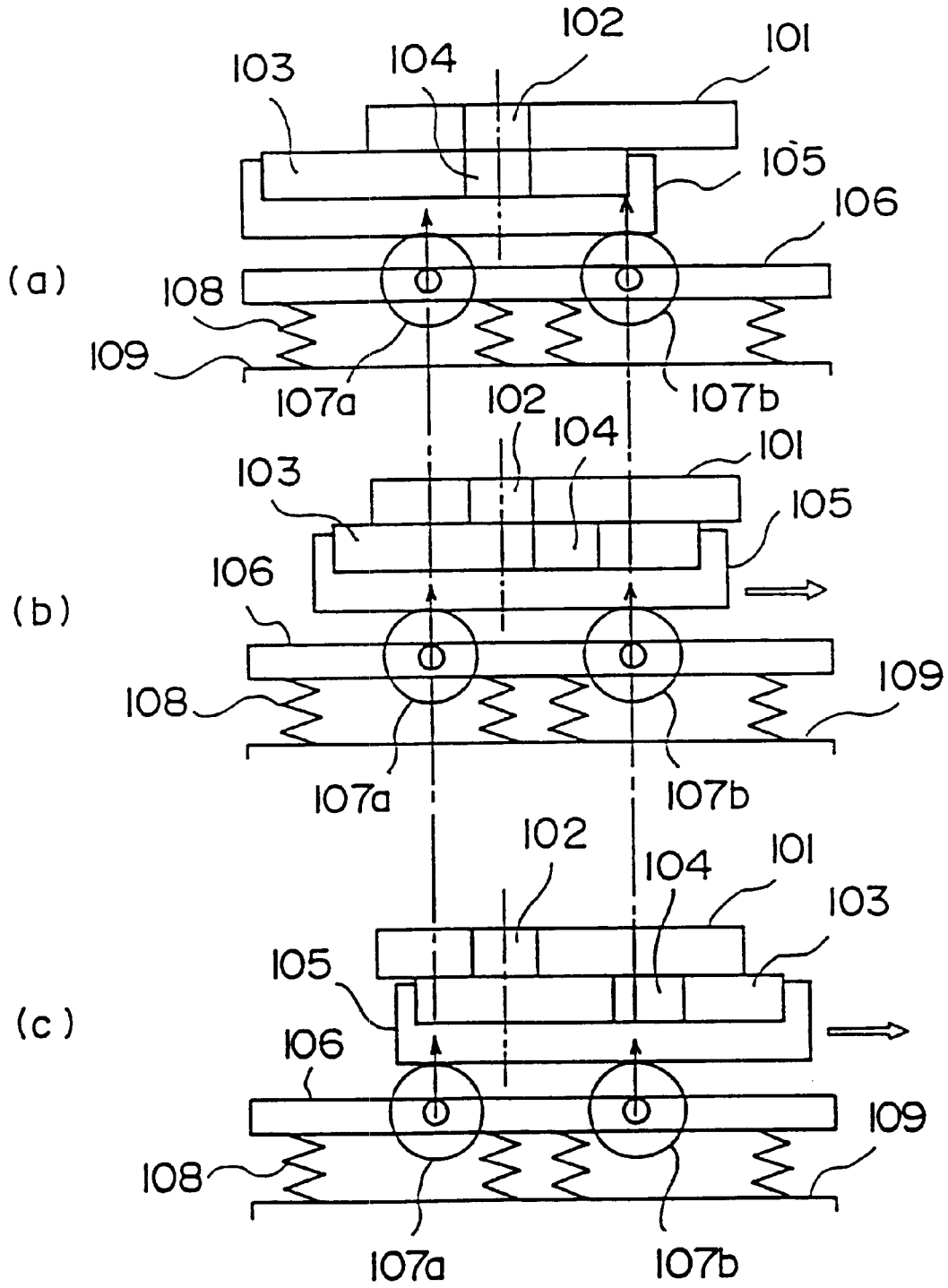
FIG. 12 PRIOR ART
FIG. 12 is an explanatory diagram for explaining an operation of a conventional fixed roller type.
Figure 13:
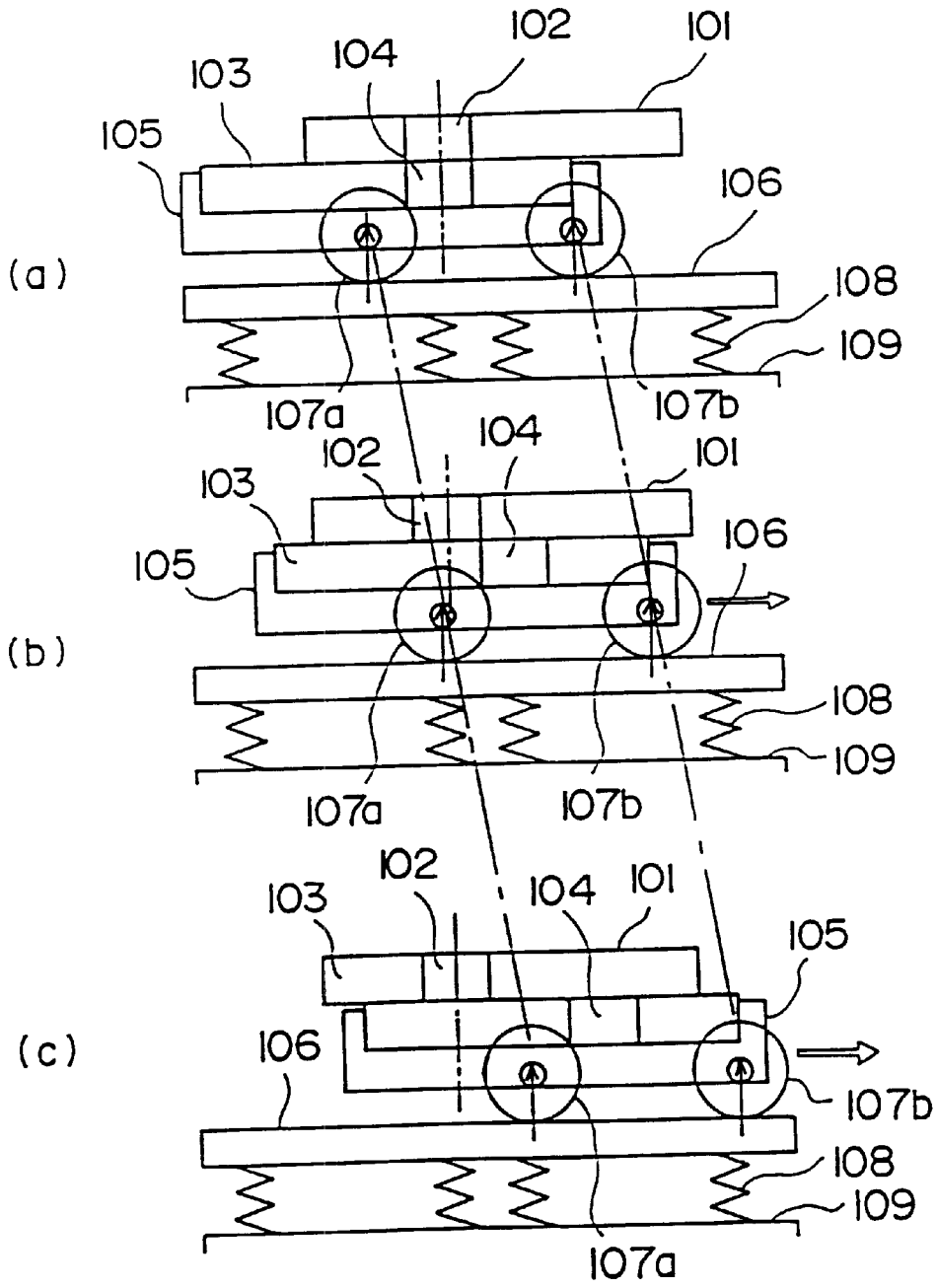
FIG. 13 PRIOR ART
FIG. 13 is an explanatory diagram for explaining an operation of a conventional moving roller type.

FIGS. 10, 11 are diagrams showing results of measuring the pressing force of each stroke directly around the nozzle holes of the fixed plate and sliding plate in the apparatus of the present invention and an apparatus employing the metal sliding type of the same structure. FIG. 10 shows the pressing force around the nozzle hole in the fixed plate and FIG. 11 indicates the pressing force around the nozzle hole in the sliding plate.

As evident from both the diagrams, the present invention A secures a higher pressing force than the metal sliding type D in substantially entire stroke region. Although in case of the metal sliding type, the length of an acting point changes with changes of the stroke, this reason is considered to be that according to the present invention, the length of the acting point does not change even if the stroke changes.

Further, as comparing the present invention with the metal sliding type, according to the present invention, the sliding resistance is very small and the pressing forces of the fixed plate and sliding plate are high, and further, it is possible to improve the operation efficiency and reduce the size of strength parts.

According to the present invention, to release a facial pressure necessary for opening or closing the door 20, the clamp 55 is inserted into the clamp insertion hole 24 of the frame 21 and the coil springs 47 are pressed down by a driving force of the hydraulic cylinder 9 through the slide frame 25 so as to improve the operating efficiency. However, in case of the metal sliding type, because the sliding resistance is large, it is difficult to employ such a system.

Although in case of the metal sliding type, the hinges and swing arms for opening or closing the door require a large pin and bushing because a frictional reaction is concentrated to these parts, according to the present invention, very small pins and bushings can satisfy their requirements because the frictional reaction applied to the door is substantially zero.

Further, according to the present invention, if speaking from maintenance viewpoints, the friction is hardly generated in the frame and slide frame because the balls are used, so that maintenance for these parts is not necessary. Therefore, the maintenance frequency is changed from a service life of the metal sliding portion to the service life of the spring. Although in case of the metal sliding type, the frame and slide frame are replaced each time when about 500 heats are reached, according to the present invention, the coil spring only has to be replaced at about 1000 heats. Consequently, not only the maintenance frequency is largely improved, but also cost of replacement parts can be reduced largely.

Second Embodiment

Here, the sliding plate particularly appropriate for the pouring amount control apparatus shown previously will be described. This sliding plate can be used for not only the aforementioned pouring amount control apparatus but also a pouring amount control apparatus of other type.

Figure 14:
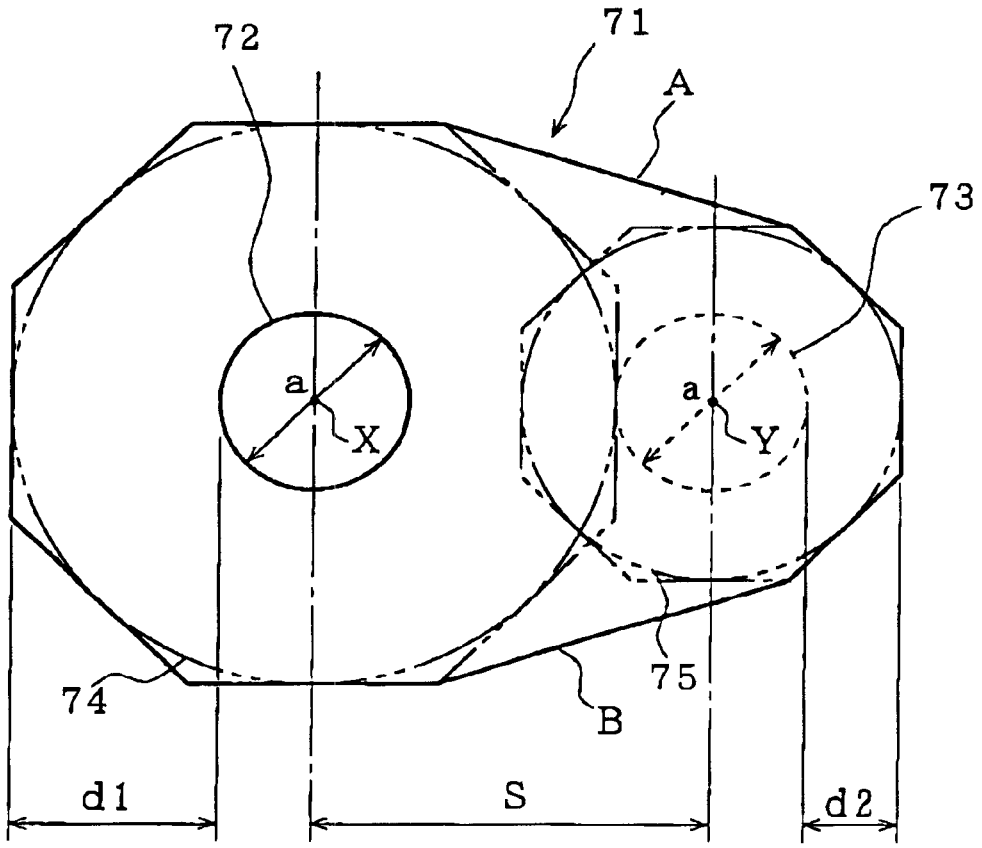
FIG. 14 is a plain view showing an example of a sliding plate of the present invention.
Figure 15:
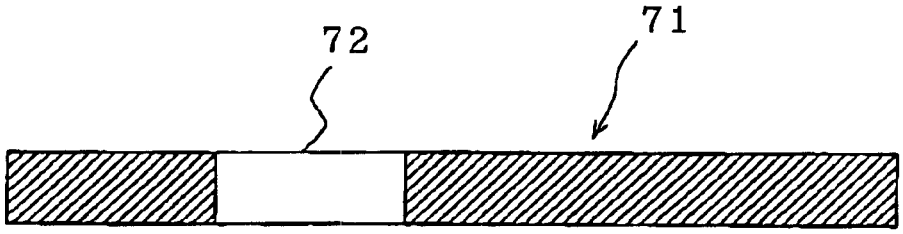
FIG. 15 is a side sectional view of the plate of FIG. 14.

Assuming that the center position of a nozzle hole 72 provided in the plate 71 is X, the diameter of the nozzle hole 72 is a, a distance from an edge of the nozzle hole 72 up to the nearest edge of the plate 71 is $d_1$, a position apart from the center position X of the nozzle hole 72 by a distance S ($=2a+\beta$) is Y, and a distance from a virtual circle 73 of a diameter a around the position Y up to the nearest edge of the plate is $d_2$, an example of the sliding plate of the present invention in which the pad ratio $\alpha_1=d_1/a$ is more than 0.8 to less than 1.5, the pad ratio $\alpha_2=d_2/a$ is more than 0.4 to less than $\alpha_1$ and safety distance $\beta$ is 0–60 mm and its outer shape is polygon is shown in a plain view of FIG. 14 and a side sectional view of FIG. 15. Meanwhile, the distance S between the positions X and Y is a slide stroke of the sliding plate.

(a) about pad ratio $\alpha_1$

Figure 16:
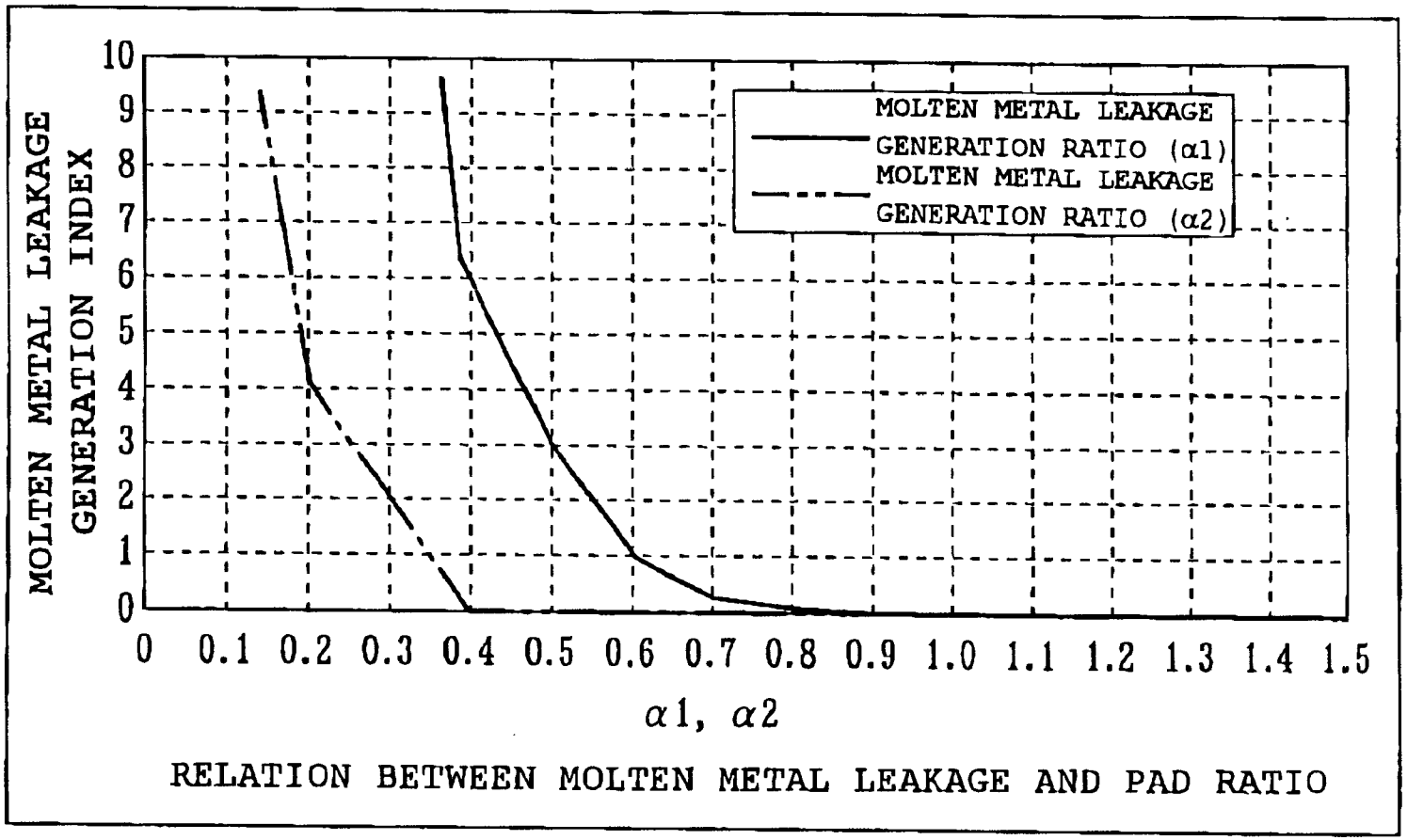
FIG. 16 is a graph showing a relation between pad ratio ($\alpha_1$, $\alpha_2$) and molten steel leakage generation index.

Although increasing the $\alpha_1$ eliminates molten metal leakage, a plate is enlarged thereby economic efficiency being lost. On the other hand, if the $\alpha_1$ is reduced, although the plate cost drops, the frequency of molten metal leakage increases. If the $\alpha_1$ drops below 0.8 as shown in FIG. 16, the frequency of the molten metal leakage increases.

(b) about pad ratio $\alpha_2$

If the $\alpha_2$ is enlarged, the economic efficiency is lost and if the $\alpha_2$ is reduced so much, the frequency of molten metal increases only if a flow of the molten metal is stopped. If the $\alpha_2$ drops below 0.4 as shown in FIG. 16, the frequency of the molten metal leakage increases.

(c) about stroke S

A moving distance of the plate is at least twice the diameter a of the nozzle hole 72.

(d) about safety distance $\beta$

Although this ensures a stroke range for the plate 71 to operate securely, if this is too large, the plate is enlarged thereby increasing the cost. Thus, the safety distance is 0–60 m.

In FIG. 14, $d_1/a=1$, $d_2=d_1/2$, $d_2/a=0.5$. Further, five pieces of an octagon touching internally the virtual circle 74 of a diameter ($a+2d_1$) around the position X and three pieces of an octagon touching internally a virtual circle 75 of a diameter ($a+2d_2$) around the position Y are connected with straight lines A, B so as to produce a plate of decagon.

Although the pad ratio $\alpha_1=d_1/a$ is 1.0, this only has to be more than 0.8 to prevent molten metal leakage and from viewpoints of economic performance, it is desired to be less than 1.5, particularly preferably more than 0.8 to less than 1.2.

Further, although in FIG. 14, the pad ratio $\alpha_2=d_2/a$ is 0.5, this only has to be more than 0.4 to prevent molten metal leakage as shown in FIG. 16, and from viewpoints of economic performance, it is desired to be less than $\alpha_1$, more preferably, less than $\alpha_1$ and from 0.4 to 0.6.

Figure 17:
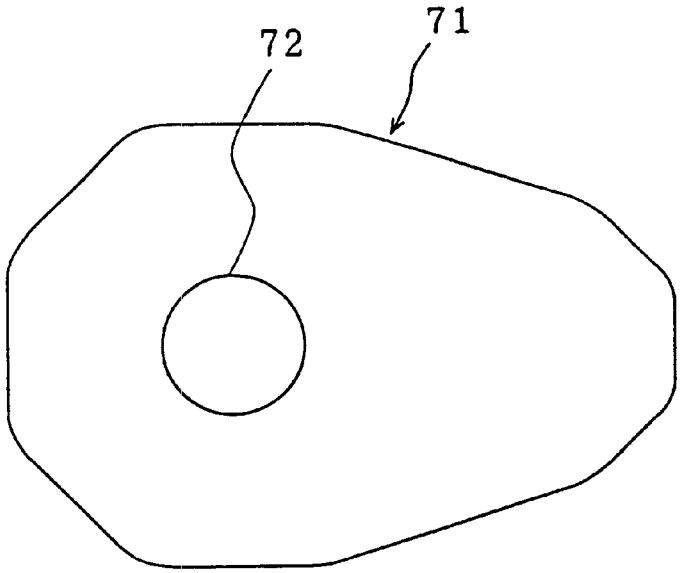
FIG. 17 is a plain view showing another embodiment of the sliding plate of the present invention.
Figure 18:
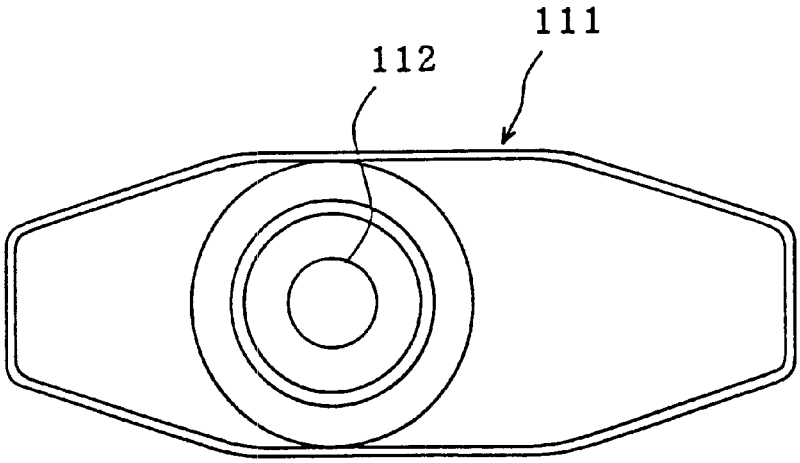
FIG. 18 PRIOR ART
FIG. 18 is a plain view showing a conventional sliding plate.
Figure 19:
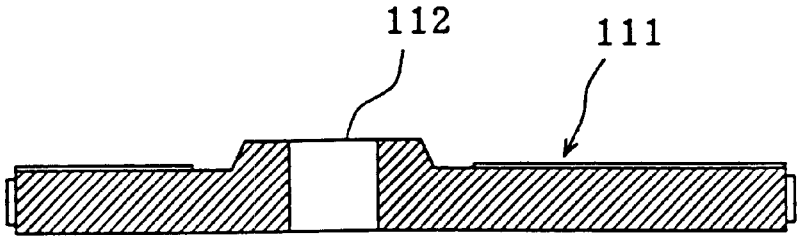
FIG. 19 PRIOR ART
FIG. 19 is a side sectional view of the plate of FIG. 18.
Figure 20:
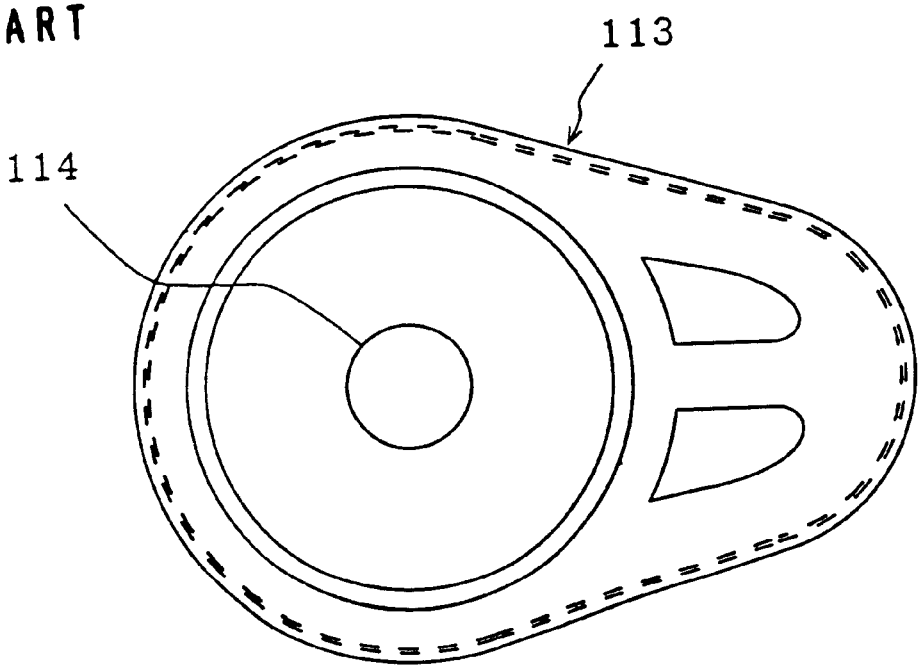
FIG. 20 PRIOR ART
FIG. 20 is a plain view showing another conventional sliding plate.
Figure 21:
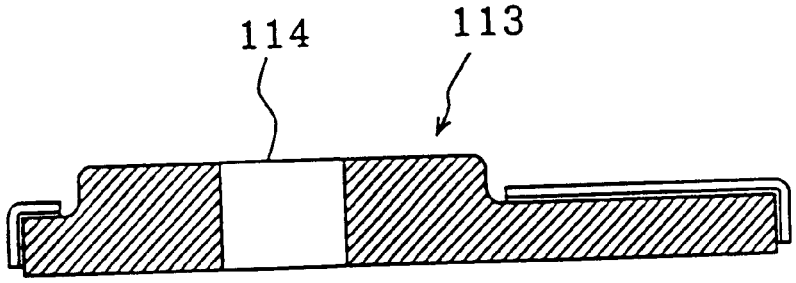
FIG. 21 PRIOR ART
FIG. 21 is a side sectional view of the plate of FIG. 20.

Although in FIG. 14, the sliding plate is formed of decagon plate, any shape is permitted as long as the sliding plate can be fixed. Meanwhile, corners of that polygon may be replaced with arc as shown in FIG. 17.

Although in this example, the plate thickness is constant as shown in FIG. 15, it is permissible to so construct that the thickness of a portion near the nozzle hole, particularly around the nozzle hole is larger than the other portions.

What is claimed is:

1. A molten metal pouring amount control apparatus comprising:

a base plate which is provided with a fixed plate having a nozzle hole and is to be attached to a molten metal container; a frame which is mounted to said base plate through a hinge in such a manner that the frame can be opened and closed;

a slide frame which is accommodated in said frame slidably in a horizontal direction, driven by a driving means and provided with a sliding plate having a nozzle hole, said sliding plate being pressed against said fixed plate by springs interposed between said slide frame and said frame, and guide units each having a plurality of steel balls disposed in line between said slide frame and said springs, said guide units being disposed on both sides of said sliding plate, wherein said frame is provided with side walls each equipped with a clamp mounting metal having a clamp guide hole through which a clamp is inserted to be protruded over said slide frame, and said slide frame is equipped with cams on its upper surface correspondingly to the protruded clamps, so that said cams et under the protruded clamps to press down the slide frame against an arguing force of said springs when the slide frame is advanced or retracted.

2. A molten metal pouring amount control apparatus according to claim 1 wherein each of said guide units includes: a retainer having a plurality of holes arranged in line so that the steel balls are accommodated rotatably in said holes with upper and lower portions of the balls being exposed through the holes; an upper lace which is provided with a guide groove on its bottom face and fixed on a bottom face of the slide frame; and a lower lace which is provided with a guide groove on its top face and fixed on a spring receiver disposed on a plurality of the springs movably up and down between a guide frame and the frame, said retainer being nipped between said upper and lower laces.

3. A molten metal pouring amount control apparatus according to claim 2 wherein each of gaps between said retainer and said upper lace/said lower lace is 0.1–1.0 mm.

* * * * *